United States Patent [19]

Breeden

[11] 4,345,435

[45] Aug. 24, 1982

[54] POWER TRANSMISSION

[75] Inventor: Robert H. Breeden, Metamora, Mich.

[73] Assignee: Sperry Corporation, Troy, Mich.

[21] Appl. No.: 146,591

[22] Filed: May 5, 1980

[51] Int. Cl.[3] ..... F04B 49/08; F15B 11/22; F15B 13/06

[52] U.S. Cl. ..... 60/420; 60/452

[58] Field of Search ..... 60/420, 426, 452, 484, 60/494; 137/596.13; 91/517, 518

[56] References Cited

U.S. PATENT DOCUMENTS

| | | | |
|---|---|---|---|
| 3,470,694 | 10/1969 | Budzich | 60/452 X |
| 3,488,953 | 1/1970 | Haussler | 91/532 |
| 3,592,216 | 7/1971 | McMillen | 91/518 X |
| 3,922,954 | 12/1975 | Gustafsson et al. | 60/426 X |
| 3,992,883 | 11/1976 | Cope | 60/494 X |
| 4,094,228 | 6/1978 | Schexnayder | 60/484 X |

*Primary Examiner*—Irwin C. Cohen

*Attorney, Agent, or Firm*—Barnes, Kisselle, Raisch & Choate

[57] ABSTRACT

A hydraulic system comprising a pair of actuators operable to move a single load, each of which has a fluid inlet, a variable displacement pump including means responsive to a pressure for varying the displacement of the pump, a pilot operated meter-in valve associated with each actuator for supplying fluid from the pump to its respective actuator, and means for sensing the pressures between each meter-in valve and its associated actuator and applying an average of said pressures to said responsive means of said pump.

4 Claims, 1 Drawing Figure

POWER TRANSMISSION

This invention relates to hydraulic systems and particularly such systems utilizing hydraulic actuators connected in parallel to move a single load.

BACKGROUND AND SUMMARY OF THE INVENTION

In hydraulic systems for moving loads such as an excavator boom it is common to utilize two actuators such as cylinders to move a single load. In such systems where there are individual valves controlling each cylinder, there is a tendency for one cylinder to provide the entire lifting force because of the difficulty in controlling the flow to each actuator.

Accordingly, an objective of the present invention is to provide a system wherein the pressures are equalized when two actuators are supplied from a pump. It is a further objective to provide such a system for use in a system shown and claimed in U.S. application Ser. No. 024,058 filed Mar. 26, 1979, now U.S. Pat. No. 4,201,052, having a common assignee with the present application, wherein pilot operated meter-in valves are used to control flow to the cylinders. In such a system, the characteristics of the meter-in are not matched perfectly. Further, if the meter-in valves are pressure compensated, there is a tendency for one cylinder to carry all of the load, and the other to have a high differential pressure drop across the meter-in valve.

In accordance with the invention the load on each actuator cylinder is sensed and the average is applied to the load responsive means for varying the displacement of a variable displacement pump.

DESCRIPTION

Figure 1:
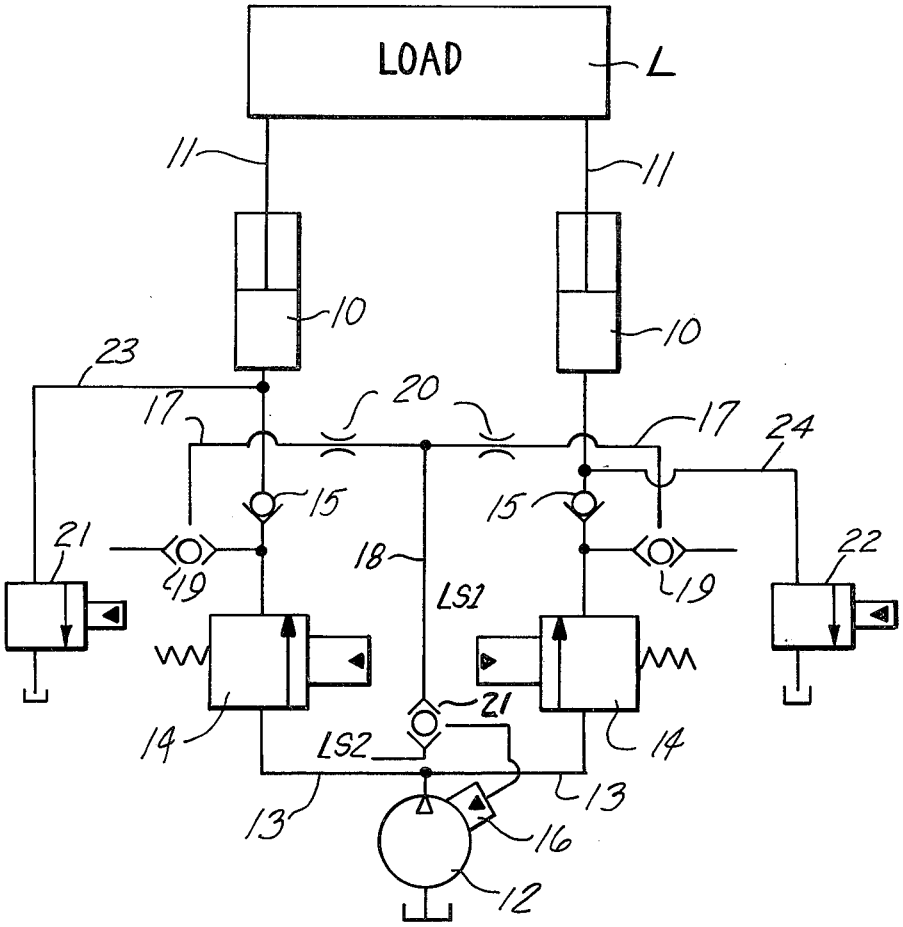
FIG. 1 is a schematic drawing of a hydraulic circuit embodying the invention.

Referring to FIG. 1, the hydraulic system embodying the invention comprises a pair of hydraulic actuators 10 in the form of cylinders having their piston rods 11 connected in parallel to a single load L. Fluid is supplied to one end of cylinders 10 by a pump 12 through lines 13. A pilot operated meter-in valve 14 in each line 13 controls the flow to its respective cylinder 10. A load drop check valve 15 is interposed in each line 13. This circuit is similar to that disclosed in the aforementioned patent application, the disclosure of which is incorporated herein by reference.

The pump 12 is of the variable displacement type including load responsive means 16 for varying the displacement of the pump. The mode of control is referred to as load sensing, and functions so that the pump provides sufficient flow to maintain the pressure in line 13 higher than the pressure in line 18 by a slight amount referred to as load sensing compensator differential pressure. As set forth in the aforementioned application, such a system includes meter-out valves 21, 22 associated with the openings of the actuators 10 through respective lines 23, 24. The pilot signal is applied selectively from a pilot signal source to the pilot of the meter-in or meter-out valves.

In accordance with the invention, a load sensing line 17 senses the pressure between each meter-in valve 14 and the associated load drop check valve 15. The lines 17 are connected to a load control line 18 extending through shuttle 21 to the load responsive means 16 on the pump 12. When additional meter-in valves, not shown, are connected to the system for supplying fluid to the rod end of the actuators, load sensing shuttles 19 are provided between the sensing lines so that the highest pressure is controlling.

An orifice 20 is provided in each line 17, the orifices being equal in size.

SUMMARY OF OPERATION

The above described system tends to equalize the lifting pressures in each of two mechanically parallel connected cylinders. Consider first the case where the pressure required to raise the load L is higher than that required for any other function supplied by pump 12. The orifices 20 function essentially to create a load sensing control pressure which is the average of the pressures between the two cylinders. The pump will be incapable of developing sufficient pressure to lift a load with only one cylinder pressurized. Thus, in the case where one meter-in valve opens in advance of another, the pressure commanded of the pump is limited to twice the pump load sensing compensator differential pressure. If the pressure required to lift the load is more than twice the load sensing differential, the load will not be raised until the second meter-in element opens. When a load is being raised, the pump will onstroke only as long as the cylinder pressures match each other within twice the load sensing compensator differential pressure.

If one cylinder is at high pressure, and the other is low, the load sensing flow will pass from the high pressure cylinder to the low pressure cylinder. Since the orifices are equal, the pressure drop across each will be equal, and the load sensing signal will be limited to the sum of pressure in the low pressure cylinder and one-half the difference between the cylinder pressures. The flow passing through the orifices will be fed to the low pressure cylinder through the load drop check. Sizing of the orifices is not critical, except that they must be equal.

Since the pump output pressure will be a given amount above the load sensing feedback pressure, the pump pressure will not exceed the higher cylinder pressure when one cylinder is twice the normal load sensing differential pressure above the lower cylinder pressure.

When considering a case where pump output pressure is determined by a load sensing signal LS2 from another function such as an additional actuator, not shown, the additional acutator is connected to the system through a load sensing shuttle 21. When LS2 is higher than LS1, the pump output pressure may be considerably higher than that required to raise a load. If one meter-in opens in advance of another because of a mismatch, there will be flow from the high pressure side through line 17. Line 17 can be sized so as to accommodate sufficient flow so that the pressure difference between the two cylinders will be within an acceptable value. The addition of line 17 does not sacrifice the load holding capability of the valve in case of line rupture, because line 17 is isolated by the load drop check valves 15.

What is claimed is:

1. A hydraulic system comprising a single load, a pair of actuators operable to act in parallel to move said single load, each actuator including an expansible chamber which when expanded moves said load in one direction, each expansible chamber of said actuator having a fluid inlet, a variable displacement pump including means responsive to a pressure for varying the displacement of the pump, a meter-in valve associated with the expansible chamber of each actuator for supplying fluid from the pump to its respective actuator chamber, a meter-out valve associated with the expansible chamber of each actuator for controlling the flow of fluid out of its respective actuator chamber, a load drop check valve between each said meter-in valve and its associated actuator chamber, and means for sensing the pressures solely between each said meter-in valve and its associated load drop check valve and applying an average of said pressures to said responsive means of said pump for varying the displacement of the pump.

2. The hydraulic system set forth in claim 1 wherein said last-mentioned means includes a load sensing line extending to sense the pressure between each said meter-in valve and its associated load drop check valve, said lines connected to one another, an orifice in each said load sensing line, said orifices being equal in size, and a load control signal line extending from said load sensing lines between said orifices to said responsive means of said pump.

3. The hydraulic system set forth in any of claims 1 or 2 wherein each said actuator is of the linear type.

4. The hydraulic system set forth in either claim 1 or 2 wherein each said meter-in valve and each said meter-out valve is pilot operated.

* * * * *